United States Patent [19]

Singleton

[11] Patent Number: 4,492,224

[45] Date of Patent: Jan. 8, 1985

[54] ORTHOPAEDIC TRACTION APPARATUS

[75] Inventor: Terence Singleton, Manchester, England

[73] Assignee: National Research Development Corporation, London, England

[21] Appl. No.: 465,456

[22] Filed: Feb. 10, 1983

[30] Foreign Application Priority Data

| | | | |
|---|---|---|---|
| Feb. 13, 1982 | [GB] | United Kingdom | 8204290 |
| Feb. 13, 1982 | [GB] | United Kingdom | 8204291 |
| Nov. 16, 1982 | [GB] | United Kingdom | 8232623 |

[51] Int. Cl.[3] ..... A61H 1/02

[52] U.S. Cl. ..... 128/75

[58] Field of Search ..... 128/69–71, 128/75, 78, 84 R, 84 B, 84 C, 87 B, 87 C, 82–83, 806; 242/100.2, 107.4 R; 254/391

[56] References Cited

U.S. PATENT DOCUMENTS

| | | | |
|---|---|---|---|
| 1,119,813 | 12/1914 | De Tar | 128/84 C |
| 2,638,091 | 5/1953 | Varco | 128/75 |
| 2,793,368 | 5/1957 | Nouel | 128/78 |
| 3,298,364 | 1/1967 | Radford | 128/75 |
| 3,699,953 | 10/1972 | Mason | 128/75 |
| 3,868,951 | 3/1975 | Albrecht | 128/84 C X |
| 4,216,959 | 8/1980 | Niles | 272/144 X |

*Primary Examiner*—Robert A. Hafer
*Assistant Examiner*—Chris Coppens
*Attorney, Agent, or Firm*—Cushman, Darby & Cushman

[57] ABSTRACT

Orthopaedic traction apparatus of the kind including a support structure carrying guides serving to direct an elongate flexible member between a patient and a suspended weight, the weight applying tractive force to the patient by way of the member, is improved by the provision of a safety mechanism of dynamic seat belt type operably connected between the support structure and the weight. The mechanism is preferably of a form having a belt arresting element operable in response to tilting from a predetermined orientation. Such a mechanism is suitably carried by a lever additionally acted on by the elongate member to maintain the mechanism operable unless the apparatus is mishandled at least in such a way as to release the member from tension. The member is preferably releasably connected to the patient by way of a device additionally allowing separate adjustment of the effective length of the member. Also proposed is the provision of an improved pelvic belt allowing alternate location on the patient for application of tractive force at his sides when supine, or at his front and rear when lying on his side.

9 Claims, 4 Drawing Figures

ORTHOPAEDIC TRACTION APPARATUS

Figure 1:
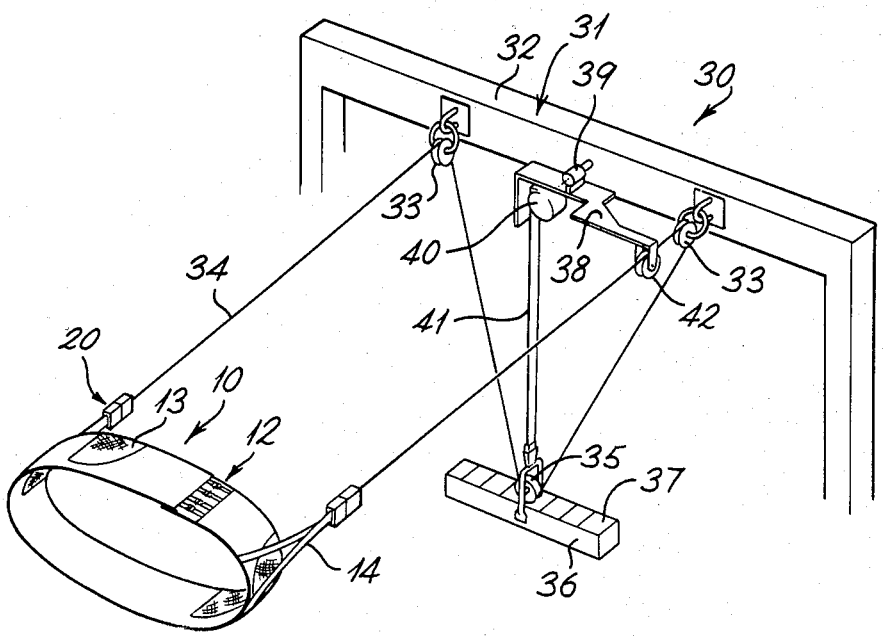

This invention concerns orthopaedic traction apparatus and more particularly such apparatus of the kind including a support structure carrying guide means serving to direct an elongate flexible member between the patient and a suspended weight, the weight applying tractive force to the patient by way of the member.

Apparatus of this kind is conveniently such as to require the attendance of a suitably trained person to apply and release the apparatus to and from to the patient. It is accordingly usual for treatment with such apparatus to involve hospitalisation on an in-patient or out-patient basis and this is costly in terms of resources.

The present invention has been conceived initially with a view to obviating this attendance requirement, but will be seen to have beneficial application even when an attendant is still involved.

According to the invention orthopaedic traction apparatus of the above-mentioned kind additionally comprises a safety mechanism of dynamic seat belt type operably connected between said support structure and said weight.

In the present context a mechanism of dynamic seat belt type is intended to mean one in which a belt is yieldable by elongation against a continuous return action and lockable by an arresting element operable in response to motion or orientation.

A general benefit of the invention is that the safety mechanism avoids the risk of the patient being subjected to an undesirable dynamic force by way of the elongate member as a result of mishandling when the apparatus is applied or released. This is of particular significance if the patient himself is controlling the apparatus because he is, by definition, subject to a disability which may make him liable to mishandle the apparatus. However, a trained attendant also is not free from some liability to error.

In a preferred form the proposed apparatus further comprises a device to releasably connect the elongate member with an anchorage on the patient, such device allowing separate adjustment of the effective length of said member.

The provision of such a device is beneficial in allowing connection of the apparatus with the patient while the member is sufficiently elongated to lower the weight from suspension, the member being thereafter shortened to elevate the weight into suspension with the safety mechanism ensuring that shortening can only occur in a suitably controlled manner. Controlled elongation of the member to lower the weight from suspension correspondingly allows safe release of the apparatus. These operations can clearly be conducted by the patient himself providing only that the connector/adjuster device is within his reach when he is located for application and release of the apparatus and, of course, providing that his condition otherwise allows for self-administration of traction. The proposed apparatus is, for this reason, suited to use in a domestic environment and, moreover, it can be largely encased to protect against accidental or other interference, which may be more likely to arise in such an environment compared to an institutional one. The same operations are also of benefit when an attendant is involved insofar as weights can be loaded and unloaded relative to a grounded carrier, this reducing the risk of injury from a weight dropped in relation to a suspended carrier.

Preferably the safety mechanism is of a form having a belt arresting element operable in response to tilting of the mechanism from a predetermined orientation rather than, or in addition to, an element responsive to belt motion. In this case the support structure has a lever pivotally mounted thereon, which lever carries the mechanism and a second guide means to direct the elongate member between the patient and the first-mentioned guide means, the mechanism and second guide means being located on the lever to maintain the mechanism in an operable orientation by balance of the forces acting on the lever when the elongate member is held under tension between the patient and weight, and to cause locking of the mechanism by imbalance of such forces to tilt the lever at least when the elongate member is released from tension. Significant forces acting on the lever for this purpose include the tension in the elongate member as applied by way of the second guide means, and the return force acting on the belt of the mechanism. Other forces acting on the lever, and which may be significant for this purpose under various conditions, include the weight of the mechanism, the component of suspended weight applied to the belt, and the weight and friction in the second guide means.

Practical development of the invention to date has centred largely on the application of traction in the conservative treatment of chronic idiopathic low back pain. Such treatment is long-established and commonly involves fastening a pelvic belt around the patient as an anchorage for the application of tractive force. In its usual form the pelvic belt comprises a strip of flexible material having fastening means at its ends, two pocketed zones spaced therealong to seat in use over the lateral pelvic protrusions of the patient, and connectors for elongate members respectively located adjacent the two zones and extending to a suspended weight or weights. Such a belt is intended for use on a supine patient but does not readily allow a different patient disposition to alleviate the incidence of pressure sores because one or other of the connectors will then be located below the patient and, at the same time, possibly affect the applied tractive force.

In order to obviate this particular situation it is further proposed according to the invention that a pelvic belt be provided having four pocketed zones therealong and two connectors respectively located adjacent alternate ones of such zones for the application of tractive force.

In use, this belt can be located with the one zones seated over the pelvic protrusions and the connectors at the sides of the patient in a normal supine position. In an alternative use the belt can be located with the other zones seated over the pelvic protrusions and the connectors respectively at the front and rear of the patient when lying on his side. Thus the patient disposition can be changed and the belt location adjusted to accomodate the same.

Figure 4:
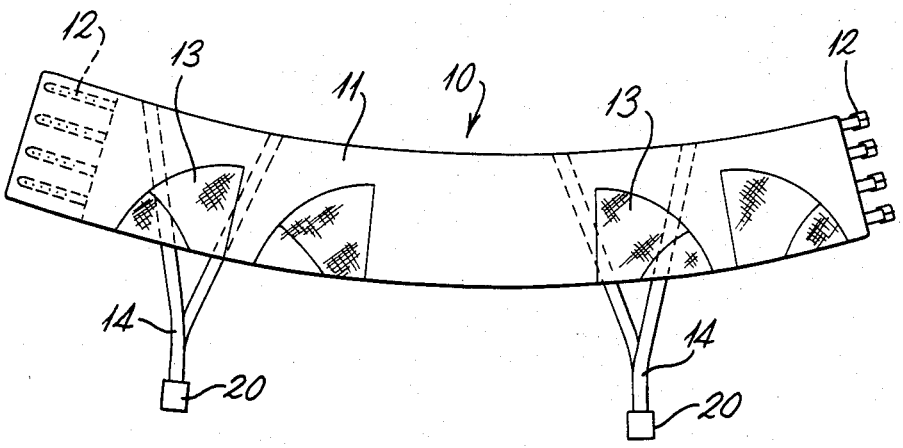
Figure 2B:
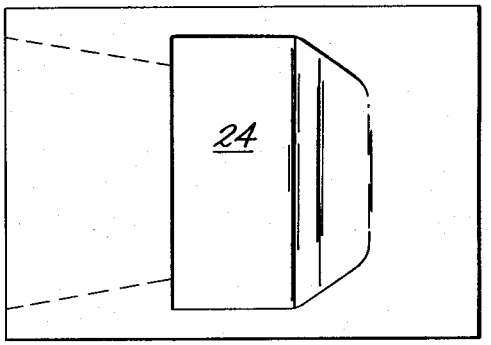
Figure 3B:
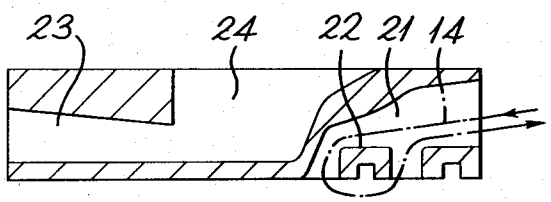
Figure 2A:
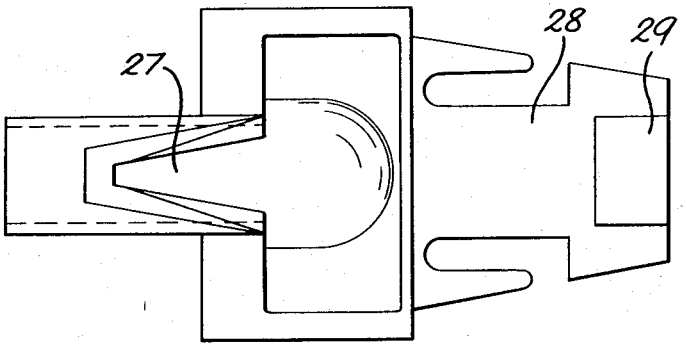
Figure 3A:
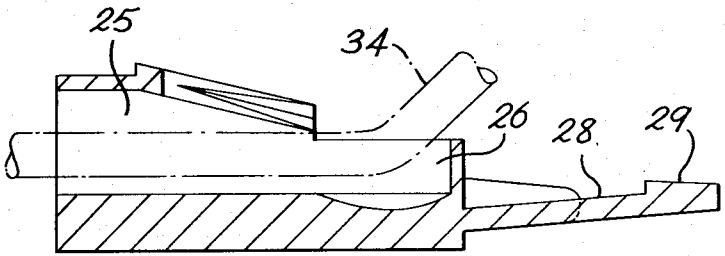

For a further and clearer understanding of the invention, the same will now be described by way of example with reference to a presently preferred embodiment thereof intended for the application of spinal traction by way of a pelvic belt. This embodiment is illustrated in the accompanying drawings, in which:

FIG. 1 schematically illustrates the relevant embodiment;

FIGS. 2 and 3 are respective plan and side view of a connector device of FIG. 1, each of the former being in two parts (a) and (b) respectively denoting male and female parts of the device; and FIG. 4 illustrates in more detail the pelvic belt of FIG. 1.

The embodiment of FIG. 1 comprises a pelvic belt 10 connected through two like devices 20 to apparatus 30 according to the invention as first discussed above, the belt and devices being of the preferred forms discussed therafter and described more fully below with reference to FIGS. 2 to 4.

The apparatus 30 comprises a support structure 31 which can be of any suitable form for stable location adjacent to, or in connection with, the foot of a bed with a part 32 of the structure disposed a short distance above the bed to avoid undesired engagement of other parts of the apparatus with the patients feet or legs. The part 32 carries two pulley wheels 33 mutually spaced thereon in a transverse sense relative to an associated bed, this spacing suitably approximating the width of a patient. A cord 34 or other flexible elongate member has its opposite end portions passed over separate ones of the pulley wheels 33 for respective connection to the devices 20. The intermediate portion of the cord is passed around a further pulley wheel 35 itself connected to a carrier 36 for a weight 37.

The apparatus 30 additionally comprises a lever 38 pivotally connected at 39 to the support part 32 between the pulley wheels 33. One end of this lever carries a safety mechanism 40 of dynamic seat belt type from which the belt 41 is extended, against a return spring within the mechanism, for connection with the carrier 36, suitably with the pulley wheel 35 interconnecting the same so that the belt and cord act together on the carrier, but without mutual physical interference. The other end of the lever carries another pulley wheel 42 located adjacent to the nearer pulley wheel 33 so that the end portion of the cord passing over the last pulley wheel 33 can additionally pass over the pulley wheel 42 towards the pelvic belt.

The mechanism 40 is of a form having a belt arresting element operable in response to tilting of the mechanism from a predetermined orientation as mentioned above. The lever and locations of the mechanism and pulley wheel 42 are such that this orientation is sustained by the action of the cord when passing under tension over the pulley wheel 42 towards the pelvic belt worn by a patient on the associated bed. In practice this situation is effectively sustained by appropriate balance between the tensile force in the cord acting against pulley wheel 42 acting on one side of the lever and the return force of the mechanism and other significant forces acting on the other side of the lever. If tension in the cord is released the remaining forces act to tilt the lever and immediately to disorientate the mechanism to lock the belt 41.

The devices 20 are of the form as more fully illustrated by FIGS. 2 and 3 with male and female parts respectively shown in adjacent mutually disconnected dispositions at (a) and (b).

The female part is formed at one end with intercommunicated cavities 21 to define a re-entrant path around a transverse bar 22 and along which a tape 14 extending from a pelvic belt can be passed as indicated in FIG. 3(*b*) in broken outline for frictional securement upon tensioning the tape. The other end of the female part is formed with an inwardly assymetrically tapered slot 23 communicating internally of the part with the base of a transverse well 24 therein.

The male part is formed at one end with a bore 25 also communicating internally of the part with the base of a respective transverse well 26, the well mouth being joined with the widest region of a tapered notch 27 extending back into the wall of the bore. This formation allows attachment of an end poriton of the cord 34 by passage into the bore and out of its well, such attachment being securable by jamming the cord into the notch, and such attachment being adjustable or releasable by pushing the cord into the well while pulling the cord. The other end of the male part is formed with a tongue 28 having a free end portion 29 which is, in the same planar aspect thereof, transversely enlarged at its rear and then forwardly tapered from both sides. This tongue and its head, together with the slot 23 of the female part, allow mutual connection and disconnection of the male and female parts. For connection the tongue and head are entered into the slot whereupon the head is first deflected by interaction between its own taper and the assymetrical taper of the slot until the head fully enters the well 24 and springs back from deflection to latch therein; while for disconnection the head is manually deflected by access through the well to allow retraction of the tongue.

The pelvic belt 10 is of a form as more fully illustrated by FIG. 4. This belt comprises a broad strip of fabric 11 having mutually co-operating fasteners 12, and four pocketed zones 13 spaced therealong. These zones, commonly referred to as ilia crest sections, are suitably of elasticated material to accommodate more readily to a given patient. A respective pair of tapes 14 are stitched across the belt adjacent each of one pair of alternate zones 13 and project from the lower side thereof in converging manner as the arms of a Y-shape for each pair of tapes with the free end portions being stitched together at the stem of this shape. The free end portions of each pair of tapes are connected with the female parts of respective devices 20.

In practice this belt will be used with the fasteners having a frontal location on the patient, but with the fasteners off-set to one side or the other of the body midline dependent upon which pocketed zones are located on the hips.

While the invention has been described with particular reference to the illustrated embodiment, it is not intended to be limited thereby and it is in fact capable of variation within the scope of the appendant claims.

For example orthopaedic traction apparatus of the kind in question in the opening discussion above can be deployed in respect of various conditions and to a variety of body parts and this is equally true for the present invention. Thus anchorage on the patient can be other than a pelvic belt and tractive force can be applied to a single location on the patient with the other end of the cord terminating at the weight carrier or therebeyond on the support structure.

Also other features of detail are variable. The support structure, for example, can be of free-standing form to afford flexibility in deployment, including use in a patient's home, or adapted for connection with a hospital bed or other such standardized structure. Also, for example, the lever arrangement can be varied such as by having the forces effective thereon applied at the same side from the pivot with the cord passing below the relevant pulley wheel to act upwardly thereon in opposition to the downward action of the inertia mechanism. Again, for example, the connector/adjustor device can take a variety of other forms affording the same desired functions for the present purpose.

I claim:

1. Orthopaedic traction apparatus comprising:

a support structure;

first guide means carried by said support structure;

connection means securable to the body of a patient;

a load;

a first elongate flexible member operably connected to extend under tension between said connection means and said load, and to engage therebetween said first guide means, to apply tractive force to said patient; and a safety mechanism including a second elongate flexible member operably connected to extend between said support structure and said load, a retractor allowing extension of said second elongate member against a continuous return action, and an arresting element operable to lock said second elongate member in response to predetermined mobile change in the condition of said mechanism.

2. Apparatus according to claim 1 wherein said arresting element is operable at least in response to tilting of said mechanism from a predetermined orientation.

3. Apparatus according to claim 2 comprising:

a lever pivotally mounted on said support structure;

said second guide means carried by said lever and located between said connection means and said first guide means;

said second guide means having said first elongate member engaged therewith to apply a first tensile force from the latter to said lever;

said mechanism being connected with said support structure by way of said lever to apply thereto a second tensile force from said second elongate member;

and said lever being normally held in a position of balance by said forces to determine said predetermined orientation for said mechanism.

4. Apparatus according to claim 1 wherein said connection means includes a harness securable with said patient body, and a connector device in two releasably interconnected parts respectively connected with said harness and first elongate member, one of said parts being adjustably connected with said second elongate member to afford variation in the operable length of the latter.

5. Apparatus according to claim 4 wherein said harness is a pelvic belt.

6. Orthopaedic traction apparatus comprising:

a pelvic belt to provide an anchorage on a patient for application of tractive force thereto when in a lying disposition, said belt having a pair of pocketed zones spaced therealong respectively to accommodate opposite lateral pelvic protrusions of said patient;

two connector devices secured to said belt respectively adjacent said pockets;

a support structure adapted to be disposed adjacent the feet of said patient;

two first guide means carried by said support structure in mutually transversely spaced disposition relative to said patient;

load applying means;

second guide means connected with said load applying means;

a first elongate flexible member connected at respective longitudinal ends thereof to said connector devices and successively engaged therebetween with one of said first guide means, said second guide means, and the other of said first guide means to extend under tension between said belt and said load applying means;

and a safety mechanism including a second elongate flexible member operably connected to extend between said support structure and said load applying means, a retractor allowing extension of said second elongate member against a continuous return action, and an arresting element operable to lock said second elongate member in response to predetermined mobile change in the condition of said mechanism.

7. Apparatus according to claim 6 wherein said pelvic belt has a further pair of pocketed zones spaced therealong in alternating sequence with the first-mentioned air of such zones selectively to accommodate in place of the latter said lateral pelvic protrusions.

8. Apparatus according to claim 6 wherein said connector devices are of like form each comprising mutually releasably latchable male and female parts, one part being secured with said belt, and the other part being adjustably secured with said first elongate member to afford variation in the operable length of the latter.

9. Apparatus according to claim 6 wherein said load applying means comprises a weight carrier suspendable by said first elongate member under tension therefrom.

* * * * *